United States Patent [19]

Mariol

[11] Patent Number: 4,995,846

[45] Date of Patent: Feb. 26, 1991

[54] TOY FIGURE WITH PIVOTAL LOWER TORSO

[75] Inventor: James F. Mariol, Cincinnati, Ohio

[73] Assignee: The Little Tikes Company, Hudson, Ohio

[21] Appl. No.: 474,570

[22] Filed: Feb. 2, 1990

[51] Int. Cl.[5] ..... A63H 3/46; A63H 3/36

[52] U.S. Cl. ..... 446/376; 446/384; 446/390

[58] Field of Search ..... 446/268, 369, 370, 371, 446/373, 375, 376, 377, 378, 379, 380, 381, 383, 384, 385, 390, 391

[56] References Cited

U.S. PATENT DOCUMENTS

| | | | |
|---|---|---|---|
| 1,155,135 | 9/1915 | Dice . | |
| 1,345,052 | 6/1920 | Williams | 446/380 |
| 1,710,989 | 4/1929 | Kelly | 446/390 X |
| 1,897,914 | 3/1932 | Schaeffer . | |
| 2,271,711 | 2/1942 | Pallett . | |
| 2,884,739 | 4/1957 | Ketcham . | |
| 3,273,280 | 9/1966 | Karton | 446/383 |
| 3,277,602 | 10/1966 | Speers et al. . | |
| 3,425,155 | 2/1969 | Ryan et al. . | |
| 3,470,650 | 4/1969 | Ferriot . | |
| 3,628,282 | 12/1971 | Johnson et al. | 446/378 X |
| 3,634,966 | 1/1972 | Ostrander | 446/380 |
| 3,699,710 | 10/1972 | Glass et al. | 446/383 |
| 3,706,155 | 12/1972 | Balza | 446/384 |
| 3,706,155 | 12/1972 | Balza . | |
| 3,816,957 | 6/1974 | Nakajima . | |
| 3,921,332 | 11/1975 | Terzian et al. | 446/380 |
| 4,279,419 | 7/1981 | Barnes et al. | 446/376 X |
| 4,373,292 | 2/1983 | Pelura | 446/268 |
| 4,571,209 | 2/1986 | Manning et al. . | |
| 4,579,543 | 4/1986 | Renger et al. . | |

FOREIGN PATENT DOCUMENTS

| | | | |
|---|---|---|---|
| 194807 | 2/1908 | Fed. Rep. of Germany | 446/376 |
| 2700776 | 7/1978 | Fed. Rep. of Germany . | |
| 3143496 | 6/1983 | Fed. Rep. of Germany | 446/376 |
| 439394 | 9/1948 | Italy . | |
| 133751 | 11/1951 | Sweden | 446/383 |
| 236788 | 9/1943 | Switzerland . | |
| 616601 | 1/1949 | United Kingdom . | |

*Primary Examiner*—Robert A. Hafer
*Assistant Examiner*—D. Neal Muir
*Attorney, Agent, or Firm*—Richard B. O'Planick

[57] ABSTRACT

A toy figure is disclosed comprising upper and lower torso sections, pivotally connected along a plane intersecting the longitudinal axis of the figure at a predetermined angle, whereby the figure is convertible from a standing configuration to a sitting configuration by rotating the torso sections 180 degrees with respect to one another. The structure is provided with a directionally oriented head component which can be adjusted into various attitudes and angles. A positive frictional pivot joint between the head and shoulder socket makes the head repositionable yet retains its position at the desired attitude and angle. The plane between the upper and lower torsos extends downardly from the front to the back of the figure at a 45 degree angle, whereby the bottom torso, when pivoted 180 degrees with respect to the top torso section, is in directional conformity with the head component.

12 Claims, 5 Drawing Sheets

TOY FIGURE WITH PIVOTAL LOWER TORSO

BACKGROUND OF THE INVENTION

1. Field of the Invention

The present invention relates to Toy Figures which are manufactured from plastic material, and more specifically to such figures which are reconfigurable from a standing to a sitting position.

2. The Prior Art

Toy Figures which are reconfigurable from a standing to a sitting position are well known in the toy industry. One type of such a figure is repositionable because of its elastomaric composition, which provides sufficient resiliency to facilitate a direct bending of the figure at the midsection. When it is desirable to have a toy figure manufactured out of hard plastic material, however, resilient bending of the figure directly into a sitting position is precluded.

U.S. Pat. No. 3,706,155 demonstrates a second general approach to reconfiguring a figure from a standing to a sitting position; that is, rotating the bottom torso 180 degrees with respect to the top of the figure. As taught by the above identified patent, the figure is separated at its midsection into upper and lower torso sections. The dividing line between the upper and lower torso is a pivot plane which extends downward from the back to the front of the figure. In order to reconfigure the figure into a sitting orientation, the lower torso is rotated 180 degrees with respect to the top torso section, and thereafter the head is pivoted 180 degrees so as to resume directional conformity with the lower torso section.

While the above patented invention works well and as intended, it has several deficiencies in its manner of operation. First, the structure is such that a 180 degree pivoting of the lower torso section with respect to the upper torso section results in the bottom torso legs being directionally opposite to the orientation of the head. This inconsistency must thereafter be corrected by rotating the head 180 degrees. In order to facilitate rotation of the head, the joint between the head and the shoulders must be of a simple neck plug configuration. Stated differently, the user of such figures may at times wish to reposition the head into various attitudes and orientations, and to retain the head in such position after the figure is transformed from a sitting to standing position. However, the structure of the above identified patented invention necessitates that the head be rotated 180 degrees so as to be brought back into directional conformity with the lower torso. This necessity makes repositionment a two-step procedure. A final deficiency is that the patented article requires the upper torso to be directionally neutral, so that the upper torso and head remain consistent when the head is rotated 180 degrees. Such a restriction, however, severely limits the degree of design detail which can be incorporated into the upper torso and arms, and therefore the toy's appeal.

SUMMARY OF THE PRESENT INVENTION

The subject invention comprises a toy figure having upper and lower torso sections pivotally connected along a plane intersecting the longitudinal axis of the figure at a predetermined angle, whereby the figure is convertible from a standing configuration to a sitting configuration by rotating the torso sections 180 degrees with respect to one another. The structure further is provided with a directionally oriented head component mounted to an upper end of the torso section, which can be tilted and pivoted into various attitudes and angles in order to duplicate the human form. Moreover, a positive frictional pivot joint between the head and shoulder socket makes the head repositionable and yet retains its desired attitude and angle of inclination until repositioned by the child.

The present invention further is structured so that the plane between the upper and lower torsos extends downwardly from the front to the back of the figure, whereby the bottom torso, when pivoted 180 degrees with respect to the top torso section, is in directional conformity with the head component. The feet of the lower torso section are nondirectional so as to make the overall figure aesthetically acceptable in both the standing and sitting positions. Consequently, the subject figure can be transformed from a sitting to a standing configuration by a single step rotation of the lower torso with respect to the upper torso. Additionally, the head can be reconfigured independently of the lower torso section, and incorporates positive retention and a frictional feel to enhance the functionality and consumer acceptance of the product.

Accordingly, it is an objective of the present invention to provide a toy figure having improved means for single step repositionment of the figure from an upright to a sitting position.

A further objective is to provide a toy figure having directionally compatible upper and lower torso sections when such sections are rotated 180 degrees with respect to each other.

Yet a further objective is to provide a toy figure having few component parts, which are readily manufacturable.

Still a further objective is to provide a toy figure which has a positive bearing interface between rotatable upper and lower portions, whereby the figure can be manufactured of relatively hard plastics material.

Still a further objective of the present invention is to provide a toy figure having a repositionable head component which can be tilted and rotated into various angular orientations to simulate the human form.

A further objective of the present invention is to provide a toy figure which is economical to manufacture out of conventional plastics material, and is readily assembled.

These, and other objectives, which will be apparent to those skilled in the art, are achieved by a Preferred Embodiment which is described below and illustrated in the accompanying drawings.

BRIEF DESCRIPTION OF THE DRAWINGS

FIG. 1(*b*) is a front perspective of the figure shown in the sitting position.

FIG. 3(*b*) is a partial longitudinal section view through the pivot joint between the upper and lower torso sections, taken along the line 3*b*—3*b* of FIG. 1(*b*).

DESCRIPTION OF THE PREFERRED EMBODIMENT

Figure 1B:
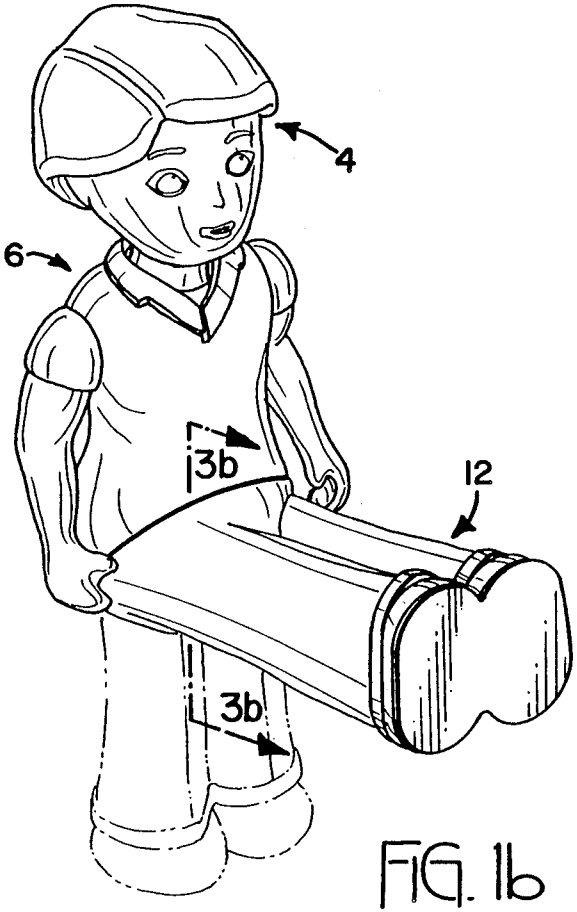
FIG. 1 is a front perspective view of the subject toy figure showing the figure in a standing orientation.
Figure 1A:
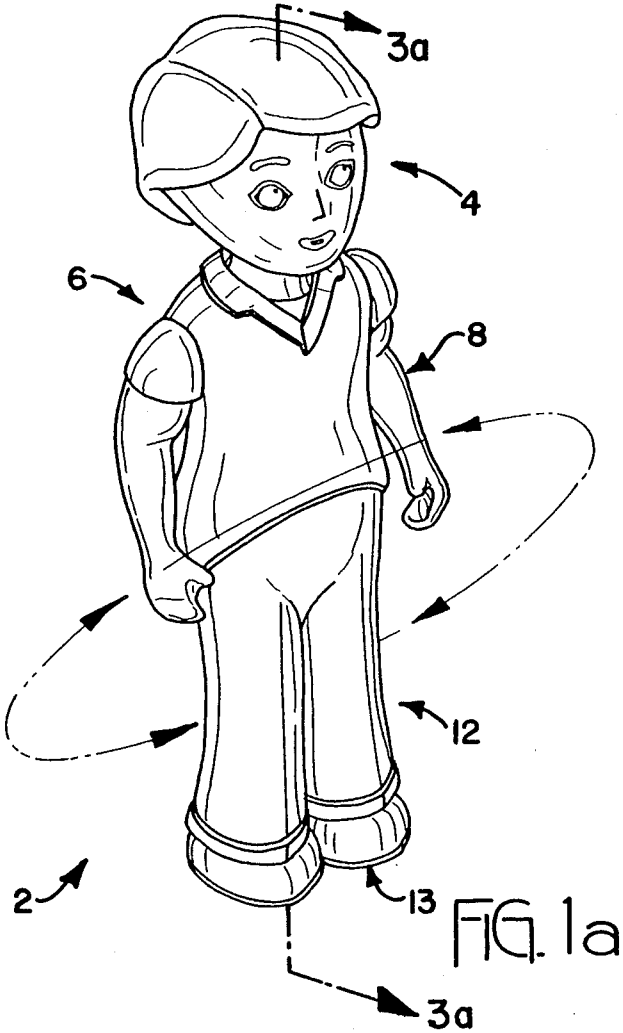
Figure 2:
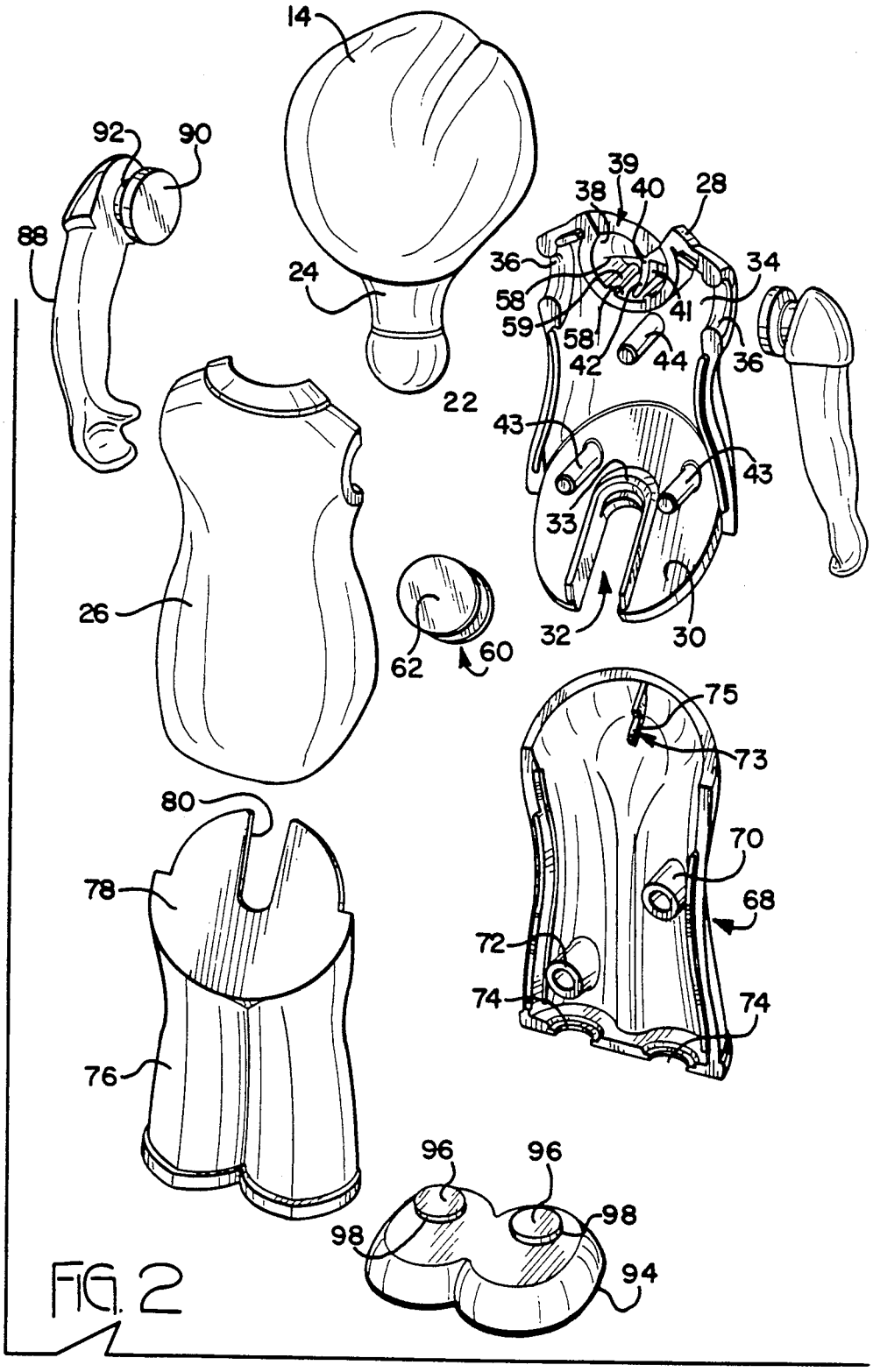
FIG. 2 is an exploded perspective view of the subject toy figure, viewed from the back.

Referring first to FIGS. 1(*a*) and 1(*b*), the subject toy FIG. 2 is shown as comprising a head assembly 4, upper torso assembly 6, arm members 8, leg assembly 12, and foot component 13. The upper torso assembly 6 and lower assembly 12 are conventionally molded out of polystyrene; arm members 8 are molded of polyvinylchloride. The head assembly 4 is composed of polystyrene material, and is likewise conventionally molded.

Figures 3A, 3B:
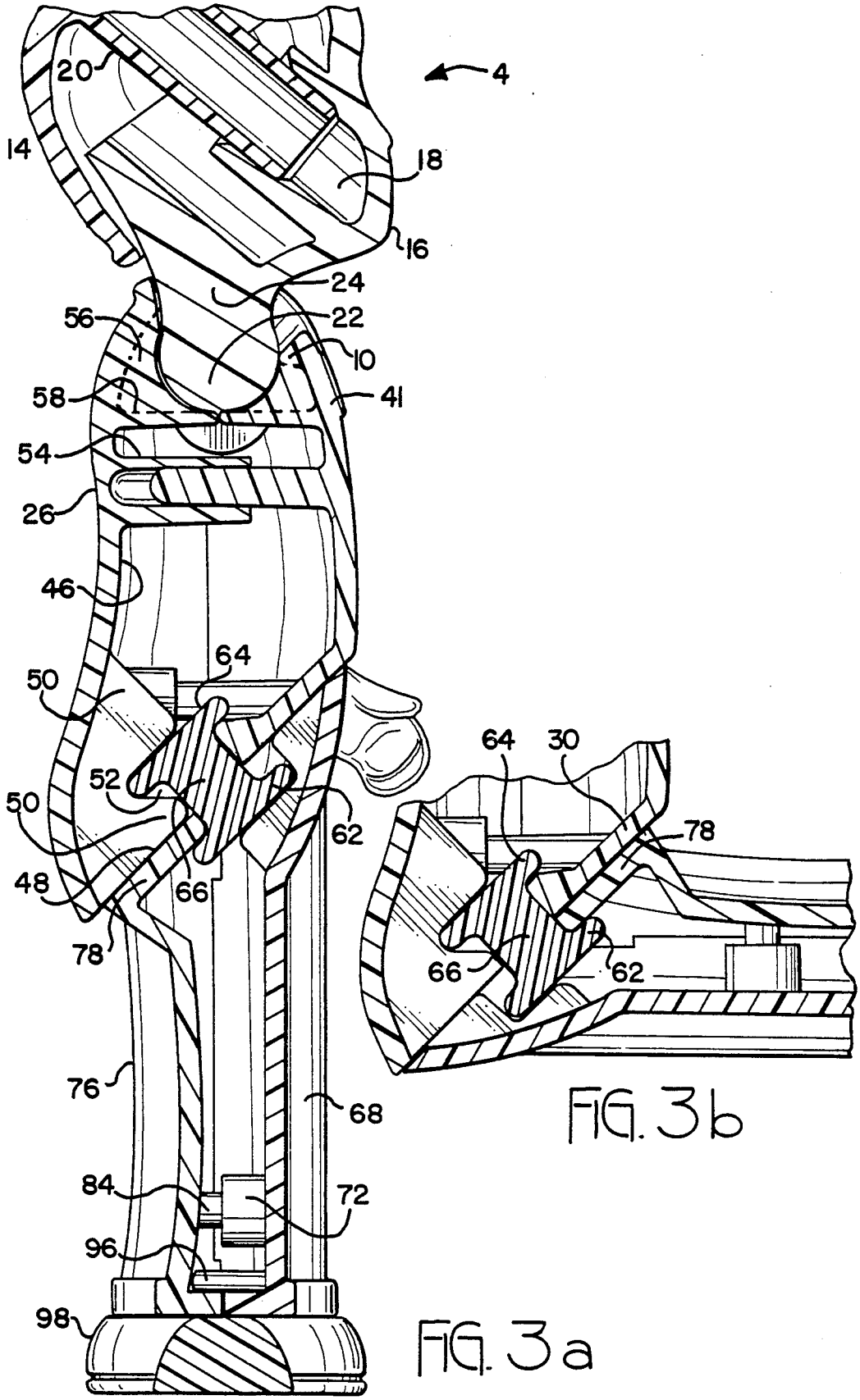
FIG. 3 is a longitudinal section view through the toy figure shown in FIG. 1(*a*) taken along the line 3*a*—3*a*.

Referring now to FIGS. 2 and 3, the head assembly is comprised of a hair component 14 and a face component 16. An internal socket 18 extends from the face component 16, adapted to receive a complementary post 20 which is integrally molded with the hair component 14.

Extending downwardly from the face component 16 and integrally molded therewith, is a ball joint 22, of ovular vertical section, connected to face component 16 by way of elongate neck portion 24.

The upper torso of the subject figure comprises a back torso section 26 and front torso section 28, of generally concave configuration, the combined components representing the body of the figure. The front torso section 28 is adapted to have a declining surface 30 at a lower end which represents the lower bearing surface of the assembly. Bearing surface 30 has a generally circular geometry, with an elongate U-shaped slot 32 extending from an outward edge into the midsection of the surface 30. As best shown in FIG. 2, an upwardly directed lip flange 33 outlines the bight of slot 32.

A concave surface 34 represents the main body of the front torso section 28 and extends downwardly to surface 30. A half circular arm socket 36 is defined by the upper end of the upper torso section 28, and a half-spherical head socket 38 is likewise defined the top of the front torso section 28. As shown in FIGS. 2 and 3, the half spherical head socket 38 at the top end of the front torso section 28 is defined in the front by a V-shaped opening 39, extending upardly from a vertical wall 40 which is one-half the height of socket 38. An arcuately profiled vertical flange 41 extends inwardly from wall 40, and includes an upwardly concave top surface 42.

As shown in FIGS. 2 and 3, the upper torso section 28 is provided with a pair of cylindrical assembly posts 43 extending from bearing surface 30, and an additional assembly post 44 extending from concave surface 34.

Figure 4:
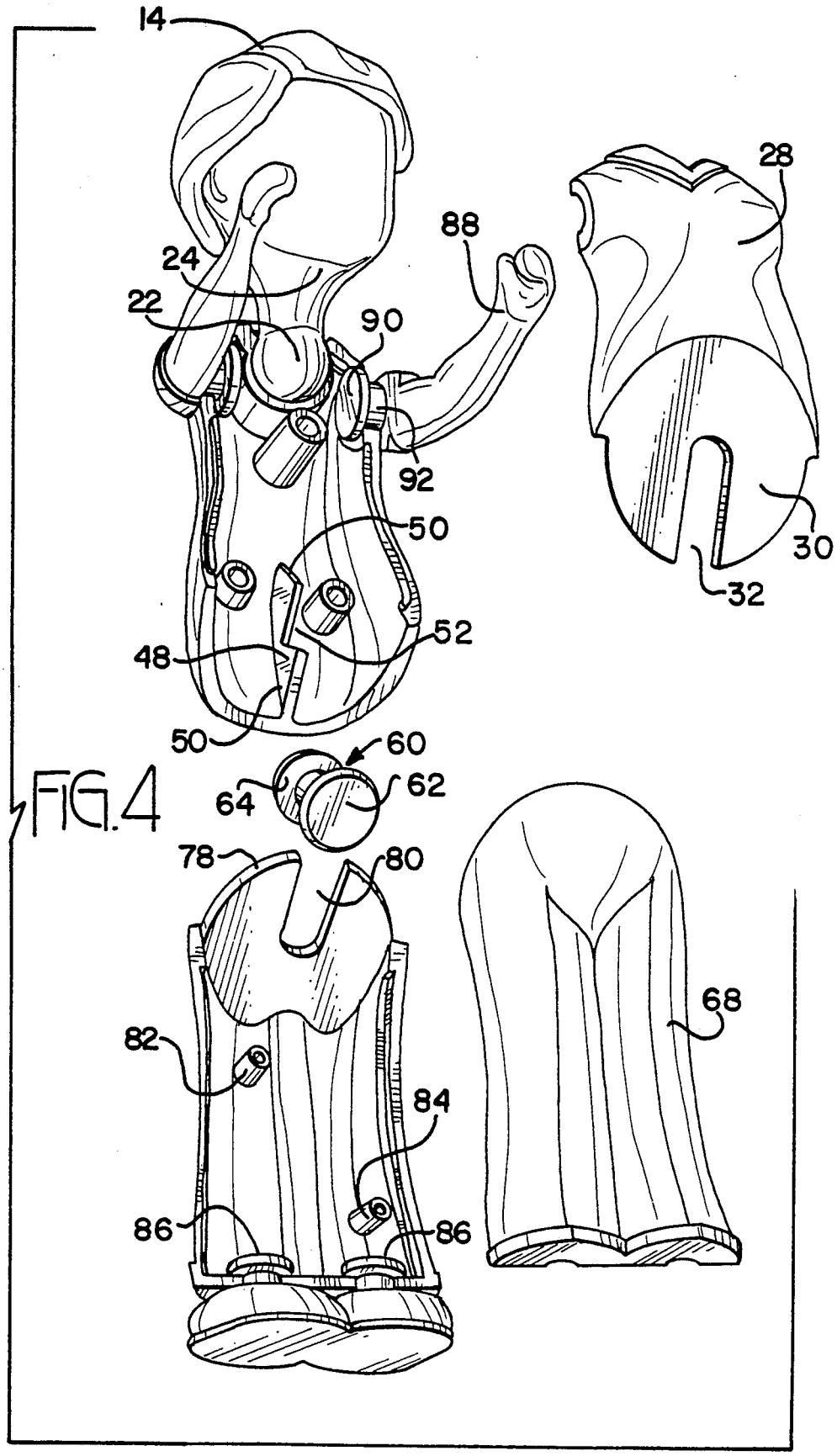
FIG. 4 is an exploded perspective view of the subject toy figure, as viewed from the front.

Referring now to FIGS. 3 and 4, the top torso back section 26 is shown to comprise a concave inner surface 46, terminating at lower edge 48. A pair of inwardly directed triangularly shaped flanges 50 extend from surface 46 and define therebetween as a triangularly shaped groove 52. A cylindrical assembly socket 54 projects outwardly from the concave surface 46. A half spherical head socket 56 is defined by the top end of the back section 26, and generally complements the half spherical head socket 38 defined by front torso section 28. Extending across a bottom surface 58 of the head sockets 56 and 38 are a pair of spaced apart, parallel ribs 59.

Referring to FIGS. 2, 3, and 4, it will be generally appreciated that the head socket formed by the front and back upper torso sections is generally spherical, being encased 180 degrees in the back by torso section 26, but being partially open in the front, defined by wall 40 which extends upward only to the mid-diameter of the socket. Flange projection 41 extends inwardly from the upper end of wall 40 to penetrate the spherical envelope defined by the head socket. It will be appreciated that the ribs 59 within the bottom surface 58 of the head socket are adapted to engage the ball joint 22 of the head assembly 4, and together with the arcuate surface 42 of flange 41, engage against ball joint 22, to thereby provide frictional resistance to the rotation of joint 22 within head sockets 38, 56. The ovular shape of joint 22 extending downward between ribs 59 ensures that the aforementioned frictional engagement is maintained yet the head 4 is still free to rotate 360 degrees within sockets 38, 56.

As shown in FIGS. 2 and 3, a hip joint 60 is provided of general dumbbell shape, comprising a lower end circular disk 62 and upper end circular disk 64, joined by a cylindrical neck 66. The purpose of the hip joint will be explained further below.

With further reference to FIGS. 2, 3, and 4, the lower leg assembly 12 is adapted having a concave front surface 68, and assembly sockets 70, 72 extending outwardly therefrom. A pair of semicircular foot sockets 74 are defined by the lower end of concave surface 68. At the upper end of the concave surface 68 and directed inwardly is a V-shaped flange extension 75, defining a V-shaped groove 73.

As will be appreciated from FIGS. 2 and 3, a concave back leg section 76 is provided having an upwardly inclined top bearing surface 78 at a top end thereof. The top bearing surface 78 is of generally circular geometry, having an internally directed U-shaped slot 80 extending from an outward edge to a midpoint thereof. As viewed in FIG. 4, the back section of the leg assembly is provided with outwardly directed assembly posts 82, 84. A pair of half circular sockets 86 are defined by the lower end of the leg section 76, and cooperate with the similarly provided foot sockets 74 in the front section of the leg assembly, to define circular apertures for the receipt of the foot component.

Referring to FIG. 2, arm appendages 8 have elongate bodies 88, which define a disk flange 90 at the top, joined to the elongate body 88 by way of neck portions 92. The foot component 94 is provide with upwardly directed disk flanges 96 of circular configuration, connected to the base by means of neck extensions 98.

With initial reference to FIGS. 2, 3, and 4, assembly of the subject article proceeds as follows. As will be appreciated, cylindrical neck 66 of the hip joint 60 is inserted into slot 32 of the top bearing surface 30, and into slot 80 of the bottom bearing surface 78. The neck 66 is dimensioned to closely reside within the slots. As the front and rearward upper torso sections 26, 28 are brought together, the upper bearing surface 30 overlaps the bottom bearing surface 78, and slots 32, 80 cooperate to define a generally circular aperture through which the hip joint 60 extends.

As will be appreciated, the head component 4 is simultaneously positioned between the torso sections 26, 28, with the depending ball joint 22 within the spherical sockets 56, 38 of the torso sections. Simultaneously, the front and rearward leg sections 68, 76, respectively, are brought together into abutment, with the foot component 94 positioned there between. The disk projections 96 of the foot component 94 are adapted to reside within the sockets 74, 86 of the leg sections and thereby affix the foot component 94 to the leg assembly.

An interference fit is achieved by appropriate insertion of the posts into the sockets of the front and rearward upper torso sections 26, 28, and the front and rearward sections of the leg assembly. As best seen in FIG. 2, 3, and 4, the simultaneous assembly of the upper torso front and rear sections, and the leg assembly front and rear sections, captures the hip Joint 60, the head ball joint 22, and the foot component 94 in their intended locations. The interference fit achieved by the insertion of assembly posts into their corresponding sockets securely assembles the components of the toy figure together.

As shown in FIGS. 3 and 4, the upper disk flange 64 of hip joint 60 resides within the V-shaped groove 52, defined by triangular bosses 50. The flange 33 which partially defines the bight of slot 32, resides under the lip of the upper disk flange 64 of hip joint 60, and secures the hip joint in a fixed position. The groove 73 defined by support flange 75 of the front lower leg section supports and retains the lower disk flange 62 of the hip joint 60. The cylindrical neck 66 of the hip joint 60 extends through the circular aperture defined by the overlapping surfaces 30, 78.

With the assembly of the appropriate upper torso sections, the arms 8 are located in their appropriate sockets, in conventional fashion, and there positioned, can freely rotate 360 degrees. It will be noted that the arms, hands, and upper body sections 26, 28 are finely detailed, and are directionally oriented consistent with each other (i.e. point in the same direction).

As explained previously, the head ball joint 22 is engaged by the ribs 59 and the projection surface 42 within the spherical head socket, and this frictional engagement provides resistance to the ball joint 22 sufficient to retain it in position at any angular attitude or rotational location. Rotation of the head 360 degrees about its central vertical axis however is freely achievable by manually overriding the frictional resistance.

Figure 6:
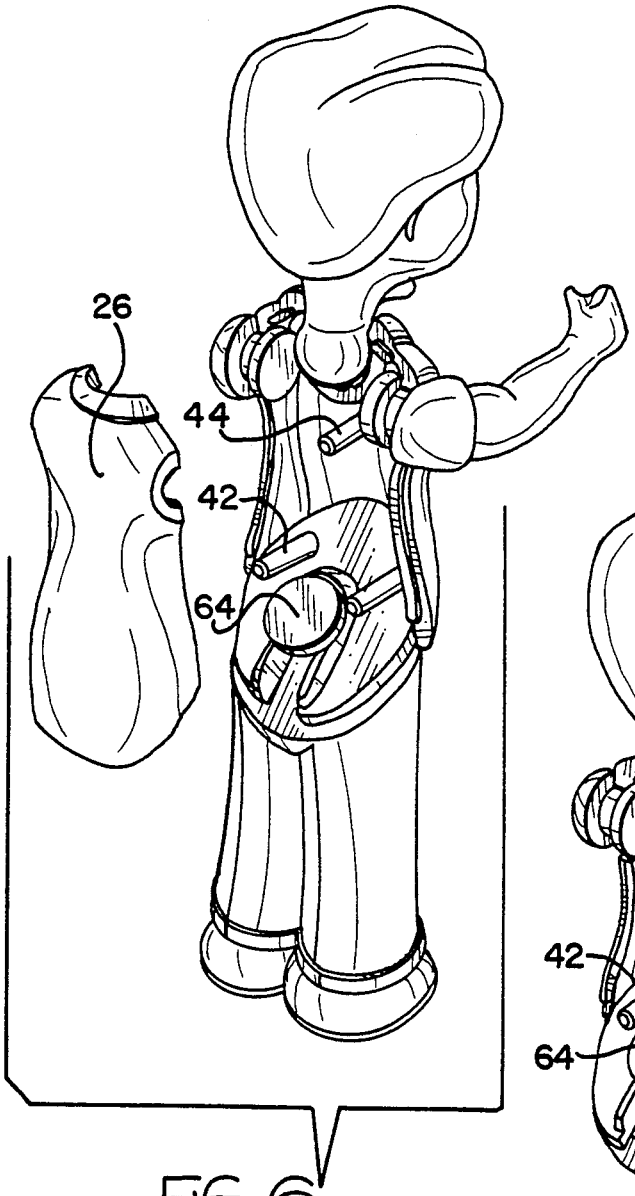
FIG. 6 is a partially assembled perspective view of the toy figure in a standing position, shown with the rear upper torso section exploded therefrom for the purposes of illustration.
Figure 5:
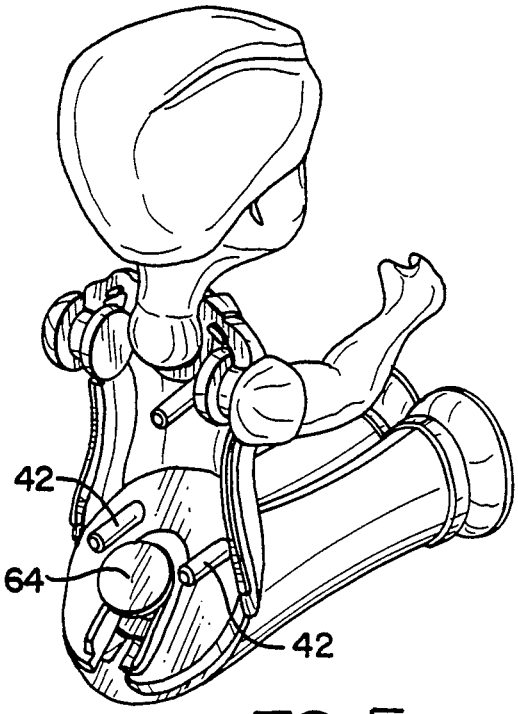
FIG. 5 is a partially assembled perspective view of the subject toy figure, shown from the rear, with the rear upper torso section removed for illustration purposes.

FIGS. 1(*a*) and 1(*b*) illustrate the manner in which the subject figure is reconfigurable from a standing position to a sitting position. The surfaces 30, 78 of the upper and lower torso sections provide a bearing surface which is angularly configured with respect to the longitudinal axis of the figure. The bearing surfaces extend downwardly from the front to the rear of the figure, substantially at a 45 degree angle. By rotating the lower leg assembly 180 degrees, as shown in FIG. 1(*a*), the legs are brought into the configuration shown in FIG. 1(*b*). Abutment of surfaces 30,78, due to the relatively hard plastics material from which the figure is manufactured, creates a smooth bearing surface for achieving this rotation. Further, the bearing hip joint 60, by being firmly secured at its upper and lower disk flanges within upper and lower torso sections, respectively, connects the sections and represents a fixed pivot axis for the hip joint. FIGS. 5 and 6 illustrate the position of the disk flange 64 and bearing surface 30 in both the sitting and standing figure orientations. It will be appreciated that the foot component of the lower torso leg assembly, and the leg portions, are directionally neutral. Consequently, as the figure lower section is rotated 180 degrees, into the configuration shown in FIG. 1(*b*), the feet and legs do not contradict the orientation of the upper torso. Further, because the intersection of the upper and lower torso sections angles downwardly from the front to the rear, rotation of the lower legs 180 degrees brings the legs into a directional orientation consistent with the head. Since the head does not need to be rotated subsequently in order to complement the legs, repositionment of the figure from a standing to a sitting orientation, and vice versa, is a single step procedure.

As will be appreciated, the frictional resistance applied to head ball bearing 22 is not comprised, and the head remains in position irrespective of the standing or sitting orientation of the legs.

While the above describes the preferred embodiment of the subject invention, the invention is not to be so restricted. Other embodiments which utilize the teachings herein set forth are intended to be within the scope and spirit of the subject invention.

I claim:

1. In a toy figure having upper and lower torso sections pivotally connected along a plane intersecting a longitudinal axis of said figure at a predetermined angle, whereby making said figure convertible from a standing configuration to a sitting configuration by rotating said torso sections 180 degrees with respect to one another, the improvement comprising:

a directionally oriented head component mounted to an upper end of said torso section;

said plane between said upper and lower torsos extending downwardly from a front to a back of said figure in said standing configuration, said bottom torso by directionally configured so that said bottom torso is directionally compatible with said upper torso and said head component when reconfigured to either said standing or said sitting configurations.

2. A toy figure according to claim 1 wherein said lower torso having directionally neutral foot appendage means affixed to a lower end of said lower torso.

3. A toy figure according to claim 1, wherein said upper and lower torso sections being bisected along said longitudinal axis of said figure into front and back sections, said upper and lower front and back sections having attachment means for securing said sections together as an assembly.

4. A toy figure according to claim 3, said upper torso front and back sections defining at a lower end a substantially planar top bearing surface, and said lower torso front and back sections defining at an upper end a substantially planar bottom bearing surface for abutment against said top bearing surface.

5. A toy figure according to claim 4, said figure including a pivot bearing member connecting said top and bottom bearing surfaces, whereby making said bearing surfaces pivotal with respect to each other.

6. A toy figure according to claim 5, said top and bottom bearing surfaces having complementary slot means for receiving said pivot bearing member.

7. A toy figure according to claim 6, said top and bottom bearing surfaces being substantially circular, said slot means comprising an elongate slot extending into each said bearing surface from an outward edge thereof, with said slot of said top bearing surface overlapping said slot of said bottom bearing surface and defining therewith a profiled aperture for receiving said pivot bearing member.

8. A toy figure according to claim 7, said bearing member having substantially a dumbbell shape comprising upper and lower disk members having opposing surfaces joined by an elongate bar, said upper and lower torso sections having internal means for retaining said upper and lower disk members, respectively.

9. A toy figure according to claim 1, said head component having a depending neck and an ovular bearing projection affixed to a lower end of said neck, said upper torso section having a neck aperture at said upper end of said upper torso section for receiving said neck, and said upper torso section and defining an internal cavity communicating with said neck aperture, profiled to seat said ovular head bearing.

10. A toy figure according to claim 9, said upper torso section internal cavity being defined by a floor, a rearward arcuate sidewall extending upwardly from said floor to encapsulate a rearward surface of said ovular bearing projection, and a forward upwardly concave flange projection extending upwardly from said floor to a midpoint of said ovular bearing, said flange projection having a concave upper surface for frictionally engaging said ovular bearing.

11. A toy figure according to claim 10, said ovular bearing being freely pivotal within said cavity subject to frictional resistance from said inwardly directed flange projection.

12. A toy figure according to claim 11, said cavity having spaced apart elongate ribs projecting upwardly from said floor and receiving an end of said ovular bearing projection therebetween, and said ribs registering and frictionally engaging said bearing projection.

* * * * *

PRINTER'S TRIM LINE

UNITED STATES PATENT AND TRADEMARK OFFICE

CERTIFICATE OF CORRECTION

PATENT NO. : 4,995,846

DATED : February 26, 1991

INVENTOR(S) : James F. Mariol

It is certified that error appears in the above-identified patent and that said Letters Patent is hereby corrected as shown below:

In Claim 1, Column 6, Line 31, delete "by" before "directionally" and substitute --bi- -- therefore.

Signed and Sealed this

Twenty-third Day of June, 1992

*Attest:*

DOUGLAS B. COMER

*Attesting Officer*

*Acting Commissioner of Patents and Trademarks*